US006553609B2

(12) United States Patent
Tremmel et al.

(10) Patent No.: US 6,553,609 B2
(45) Date of Patent: Apr. 29, 2003

(54) APPARATUS FOR FLOOR CLEANING

(76) Inventors: Dieter Tremmel, Wilhelmshavener Str. 97, Nurnberg (DE), 90425; Peter Belkhofer, Poststrasse 16, Forchheim (DE), 91301; Andreas Kistner, Markplatz 8, Merkendorf (DE), 91732; Michael Kotz, Ahornweg 9, Forchheim (DE), 91301; Christian Neumann, Beethovenstr. 16, Hagenau (DE), 91083; Markus Merkl, Riggau 22, Pressath (DE), 92690; Holger Sandner, Kolbstr. 7, Bubenreuth (DE), 91088

( * ) Notice: Subject to any disclaimer, the term of this patent is extended or adjusted under 35 U.S.C. 154(b) by 0 days.

(21) Appl. No.: 09/836,885

(22) Filed: Apr. 17, 2001

(65) Prior Publication Data

US 2001/0032372 A1 Oct. 25, 2001

(30) Foreign Application Priority Data

Apr. 20, 2000 (DE) ..... 100 19 682

(51) Int. Cl.[7] ..... A47L 11/202

(52) U.S. Cl. ..... 15/320; 15/340.3; 15/340.4; 15/385

(58) Field of Search ..... 15/320, 340.3, 15/340.4, 385

(56) References Cited

U.S. PATENT DOCUMENTS

| | | | | | |
|---|---|---|---|---|---|
| 4,158,901 | A | * | 6/1979 | Wulff et al. | 15/320 |
| 4,317,252 | A | * | 3/1982 | Knowlton | 15/320 |
| 5,485,653 | A | * | 1/1996 | Knowlton et al. | 15/320 |
| 5,742,975 | A | * | 4/1998 | Knowlton et al. | 15/320 |
| 6,212,731 | B1 | * | 4/2001 | Eckerlein et al. | 15/320 |

* cited by examiner

*Primary Examiner*—Chris K. Moore
(74) *Attorney, Agent, or Firm*—Rankin, Hill, Porter & Clark LLP

(57) ABSTRACT

The invention relates to an apparatus for floor cleaning, with several wheels 4, 5, 6 being attached to a frame R in such a way that a curve movement about a momentary center MP, MP1, MP2 can be performed and all momentary centers MP, MP1, MP2 form a momentary center axis MA extending substantially transversally to the frame R, and with a cleaning device 24*a*, 24*b* being received in the frame R, which cleaning device forms a cleaning surface area RF which is delimited by a circumferential edge. In order to reduce uncleaned residual surfaces when moving along contours it is provided in accordance with the invention that the momentary center axis MA forms at least one point of intersection S1, S2 in a section of the circumferential edge disposed in the zone of the longitudinal side of the frame R.

17 Claims, 12 Drawing Sheets

APPARATUS FOR FLOOR CLEANING

The invention relates to an apparatus for floor cleaning according to the preamble of claim 1.

Such apparatuses can be arranged in particular as scrubbing vacuum machines. One or several cleaning brushes act upon the floor surface to be cleaned. Cleansing liquid is sprayed onto the floor surface in the zone of the cleaning brushes and thereafter removed again from the floor surface with the extracted dirt under the influence of a suction apparatus and transferred to a dirty-water collecting vessel.

An apparatus for floor cleaning of this kind is known from DE 197 52 450 A1 for example. Swivelably front and rear wheels are provided on a frame. A circular brush is attached between the front and rear axle which are formed by the wheels. The known apparatus has the disadvantage that when moving around contours, e.g. shelves in supermarkets and the like, a relatively large surface area of the floor is not covered by the cleaning brush. It is necessary to subsequently clean the remaining uncleaned areas again.

In order to remedy the aforementioned disadvantage a floor cleaning device is proposed in DE 42 30 196 in which an additional brush device is provided which can be swiveled out laterally. The provision of such an additional brush device increases the weight of the apparatus, has a negative effect on its versatility and causes costs.

A floor cleaning device is known from DE 196 44 570 A1 in which merely one axle with two wheels is provided. A part of the weight of said floor cleaning device acts on a circular brush disposed in front of the axle. The apparatus is difficult to handle.

A floor cleaning device is known from U.S. Pat. No. 1,472,208 in which two rigid front casters and a swivelable rear caster are attached to a frame. A cleaning device is received on the frame between the front and rear casters. During curve movements, an axis of the momentary center of the curve movement, i.e. the so-called momentary center axis, which extends through the rigid front casters is far outside of a cleaning surface as defined by the cleaning device. When moving around edges there is always a transversal movement of the cleaning device. Uncleaned residual surfaces remain.

A further floor cleaning device is known from DE 41 03 087. A momentary center axis extending through the rigid front wheels intersects the cleaning surface. It does not intersect the cleaning surface in the zone of a circumferential edge of the cleaning surface which is located in the zone of the longitudinal side of the frame. Transversal movements of the cleaning device also occur in this floor cleaning device during curve movements. Uncleaned residual surfaces also remain in this case as well.

It is the object of the invention to eliminate the disadvantages according to the state of the art. An apparatus for floor cleaning is to be provided in particular which is easy to handle. Furthermore, the surface areas remaining when moving past contours are to be as small as possible.

This object is achieved by the features of claim 1. Appropriate embodiments are obtained from the features of claim 2 to 17.

It is provided within the terms of the invention that the momentary center axis forms at least one point of intersection with a section of the circumferential edge which is disposed in the zone of the longitudinal side of the frame.

The momentary center is understood as being a pole, i.e. a static point, about which a leg of a trajectory can be performed with the apparatus. In apparatuses for example with a rigid rear axle and swivelable or steerable front wheels, all momentary centers are disposed on the rear axle or an imaginary lateral extension thereof. A momentary center axis is defined by all momentary centers of an apparatus.

A cleaning surface of the apparatus is defined by the rotating cleaning means, e.g. the circular brushes. The cleaning surface is delimited by a circumferential edge. A section of the circumferential edge can be limited by the longitudinal side of the frame. A section of the circumferential edge is located in the zone of the longitudinal side of the frame when the momentary center axis intersects a lateral 45° sector of the circumferential edge.

With the apparatus in accordance with the invention the swinging out of the front or the rear while moving past contours is avoided. The portion of uncleaned residual surface areas and the passage width can thus be kept to a minimum. The apparatus is easy to handle.

According to a preferable feature of the embodiment the momentary center axis extends in the vicinity of the vertical projection of the center of gravity of the apparatus. At least one non-steerable wheel can be attached on the momentary center axis close to the vertical projection of the center of gravity. Moreover, at least two, but preferably four swivelable and steerable wheels can be attached to the frame. Such an apparatus is particularly easy to handle and tilt-resistant.

According to a further embodiment two driven wheels are arranged on the momentary center axis. In this case the driven wheels can be driven with a different speed and/or in different directions of rotation. This variant is also characterized by versatility and ease of handling capability, particularly where riding apparatus are concerned.

It is provided according to a further embodying feature that at least one steerable wheel is attached to the frame. It is understood that also several steerable wheels could be provided. If steerable front and rear wheels are provided which are not disposed on the momentary center axis, the steering of the front and rear wheels must be performed in such a way that their axes always intersect on the momentary center axis when turning the wheels during steering.

The cleaning device is appropriately provided with at least one, preferably two or three, circular brushes, or at least one cleaning roller.

It is regarded as being particularly advantageous that a supply unit which is arranged as an exchangeable module comprises a tank, a dirt receiving device and a power supply unit. The module can be removed from the frame with ease by using a suitable docking station. Operating material can be added in the docking station, the power supply unit can be recharged and the dirt-water receiving device can be emptied. In order to ensure uninterrupted continuation of the work, the module can be exchanged for one with fresh operating material. An apparatus of this kind in combination with one or several features as set out in this paragraph can form per se a separate invention.

Preferably, the at least one non-steerable wheel is attached vertically movable relative to the swivelable wheels on the frame. For this purpose the at least one non-steerable wheel can be received in a lifting apparatus. It can concern, for example, a resiliently held rocker, a spring or a parallelogram-like lifting apparatus. It has further proven to be advantageous that a device is provided for setting the distribution of the load among the at least one non-steerable wheel and the swivelable and steerable wheels. The aforementioned features contribute further to the easy handling capability of the apparatus and the adjustment to the different permissible surface loads of the floor.

It is appropriate that a motor for driving the at least one driven wheel is attached to the frame. When the module is removed it is not necessary to additionally remove the motor from the frame.

It is further appropriate when at least one stop wheel is provided on a lateral brush cover. The apparatus can thus be guided without any frictional losses along a wall for example or precisely about a contour such as a corner or an edge. The stop wheel can be arranged with an axial offset Δy in front of the momentary center axis, with the following applying:

$$\Delta y = a\, D_{brush\ diameter}$$

with a being capable of assuming values from 0.15 to 0.35 and $D_{brush\ diameter}$ being the diameter of the brush. It has proven to be particularly advantageous to use a value of 0.25 for a. If several stop wheels are provided one after the other on the lateral brush cover, it is necessary, with respect to the axial offset Δy, to consider the distance of a central axis defined by the central points of the stop wheels towards the monopole axis. The central axis extends parallel to the monopole axis and intersects a connecting line between the central points in the middle which are farthest away from one another.

According to a further embodiment, a housing contour in the zone of the cleaning device is disposed at least over sections on the circumference of a circle imagined about a central momentary center. This facilitates in particular the driving around edges, and the driving over edges.

It has proven to be particularly advantageous that the at least one point of intersection is disposed on an outermost lateral section of the circumferential edge preferably projecting beyond the longitudinal side of the frame. In this case there is no transversal movement of the cleaning device during a curve movement. The cleaning surface area can be guided with high precision along the contours. Corners can be cleaned substantially, so that the portion of uncleaned residual areas is minimal.

Embodiments of the invention are explained below in closer detail by reference to the enclosed drawings, wherein.

Figure 7B:
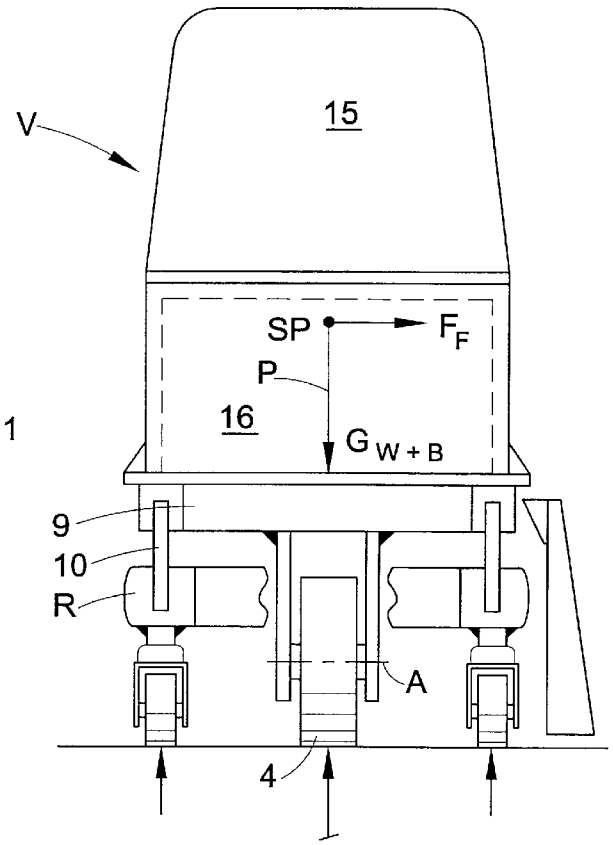
Figure 7A:
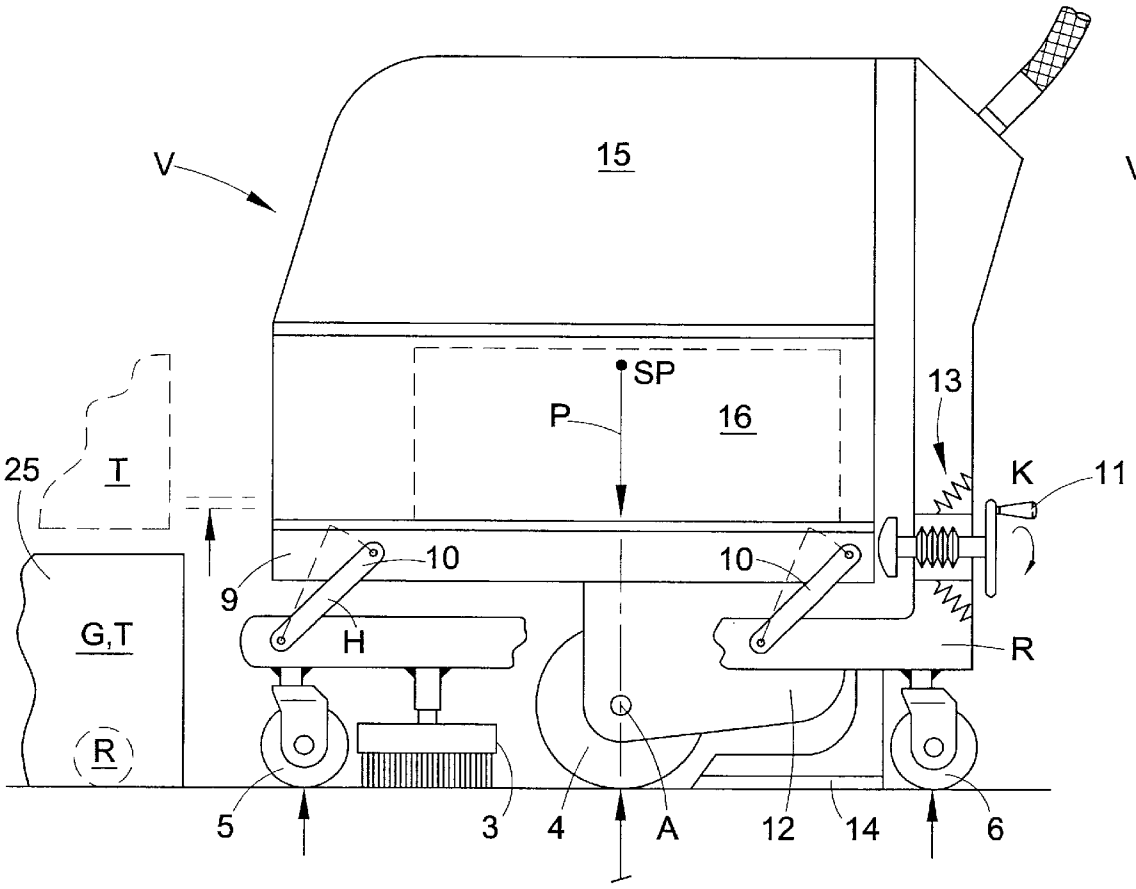

FIGS. 6*a* to *e* schematically show different possibilities for receiving a central wheel;

FIG. 7*a* shows a schematic side view of a third floor cleaning apparatus;

FIG. 7*b* shows a schematic rear view of the floor cleaning apparatus according to FIG. 7*a;*

Figure 8A:
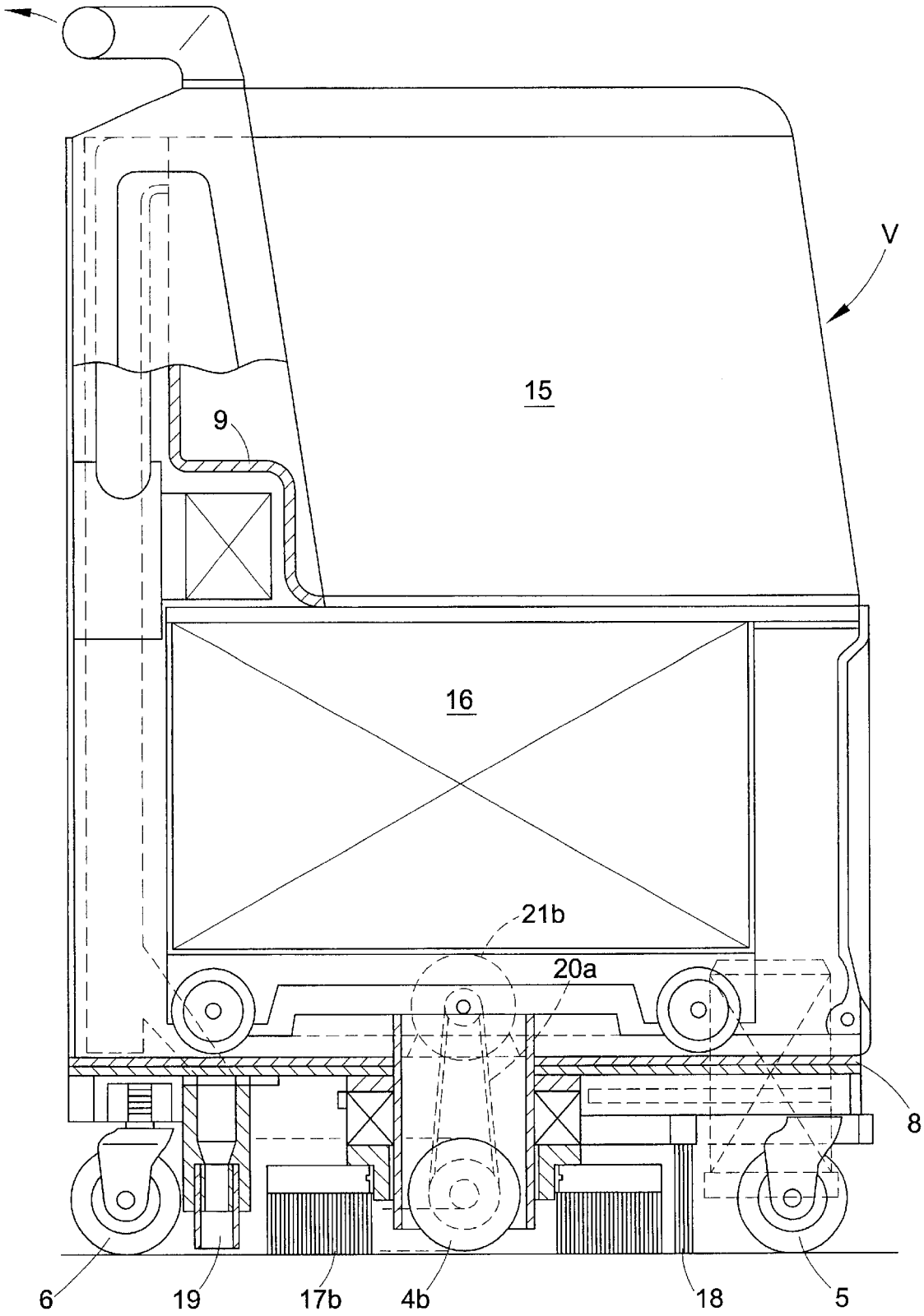
Figure 8B:
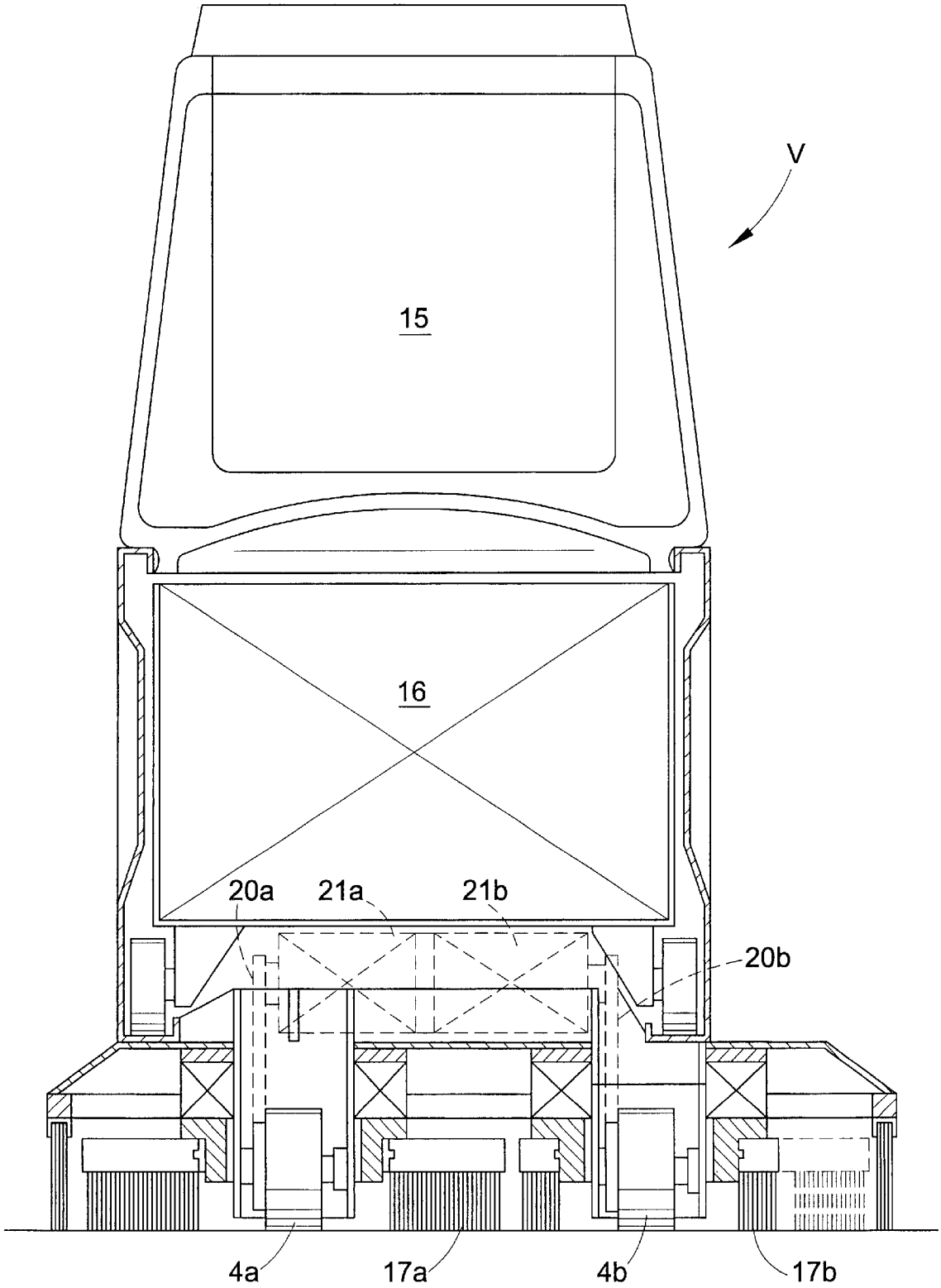

FIG. 8*a* shows a schematic side view of a fourth floor cleaning apparatus;

FIG. 8*b* shows a schematic rear view according to FIG. 8*a;*

Figure 8C:
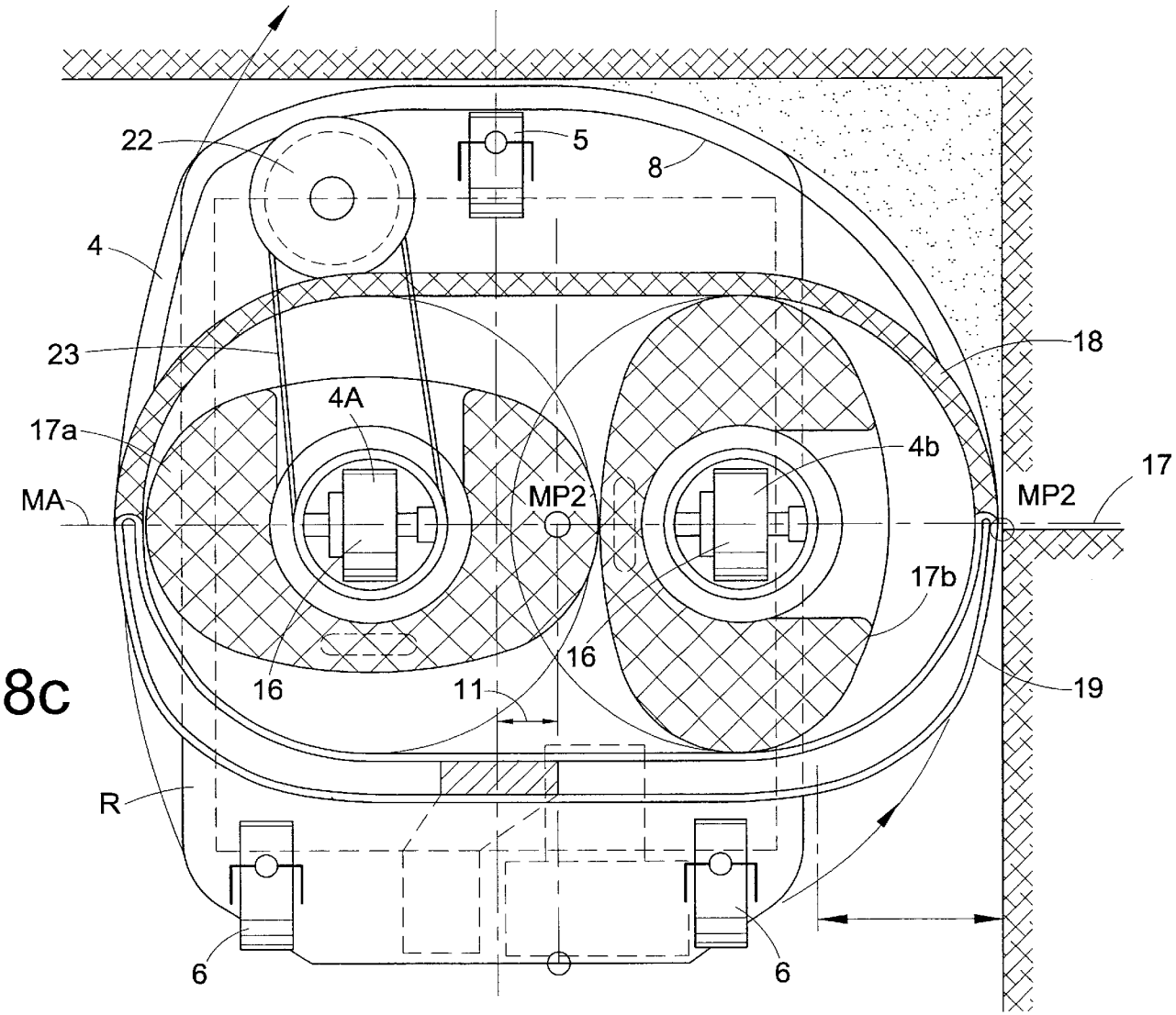

FIG. 8*c* shows a bottom view according to FIG. 8*a;*

Figure 9:
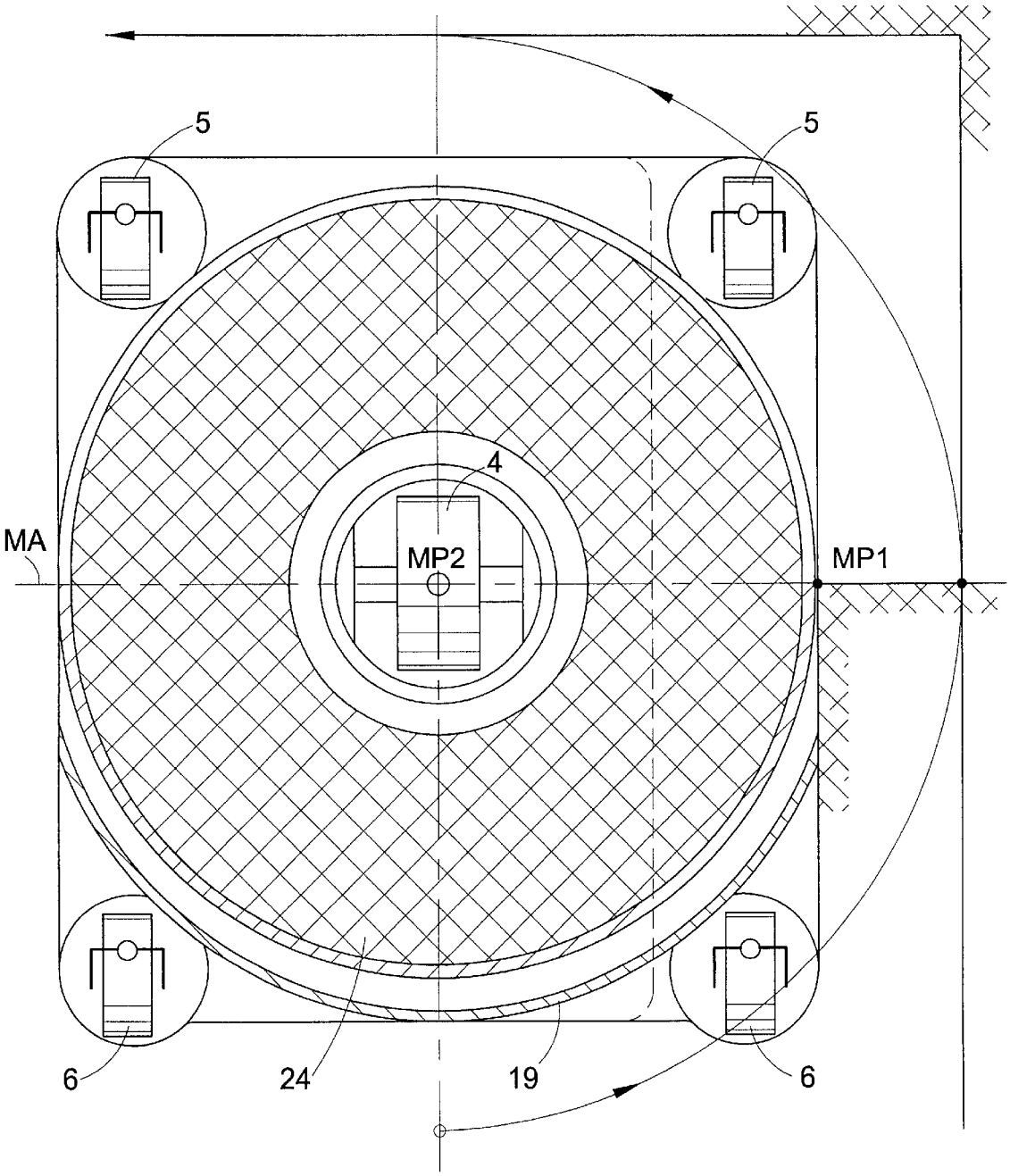
Figure 10:
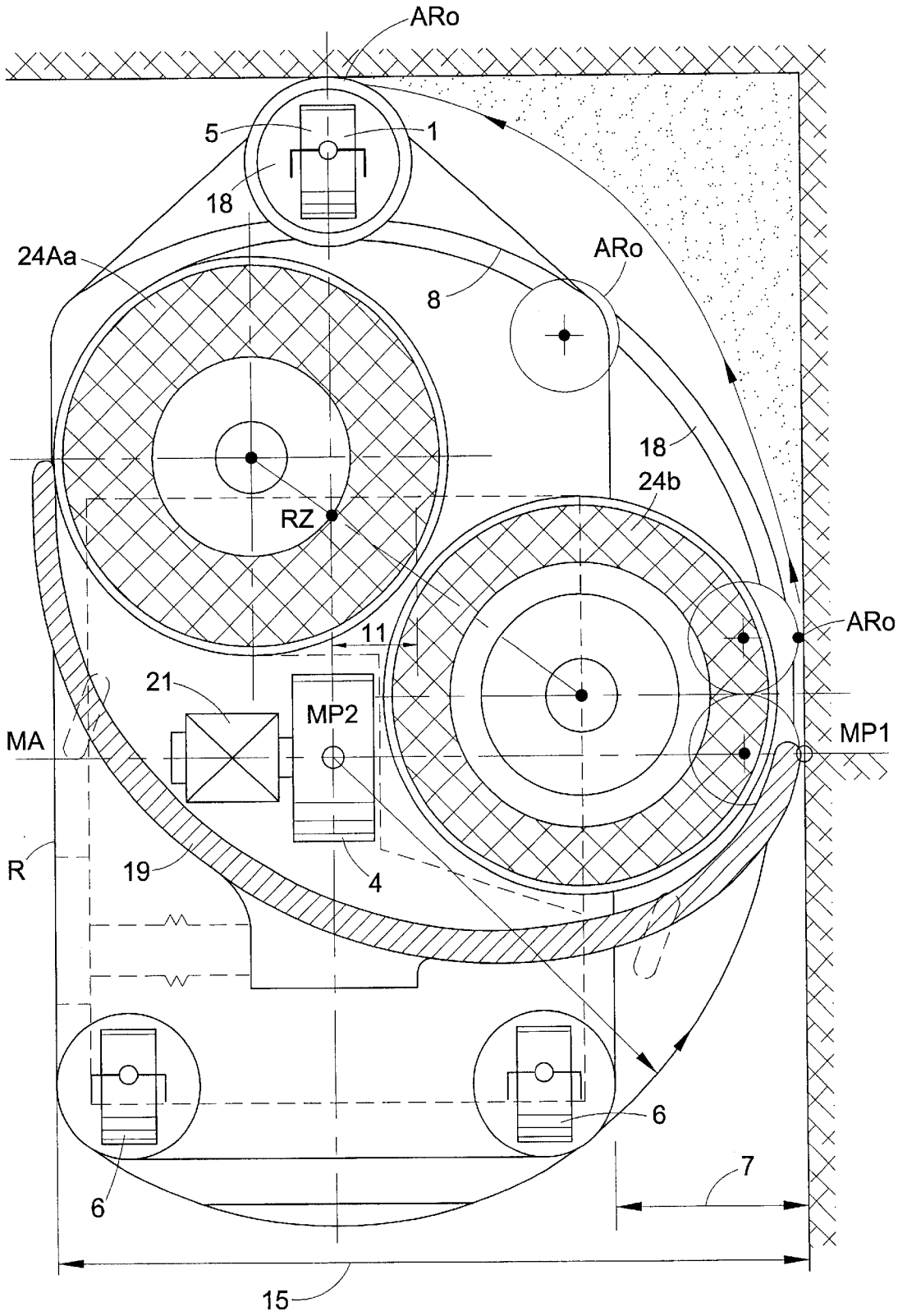
Figure 11:
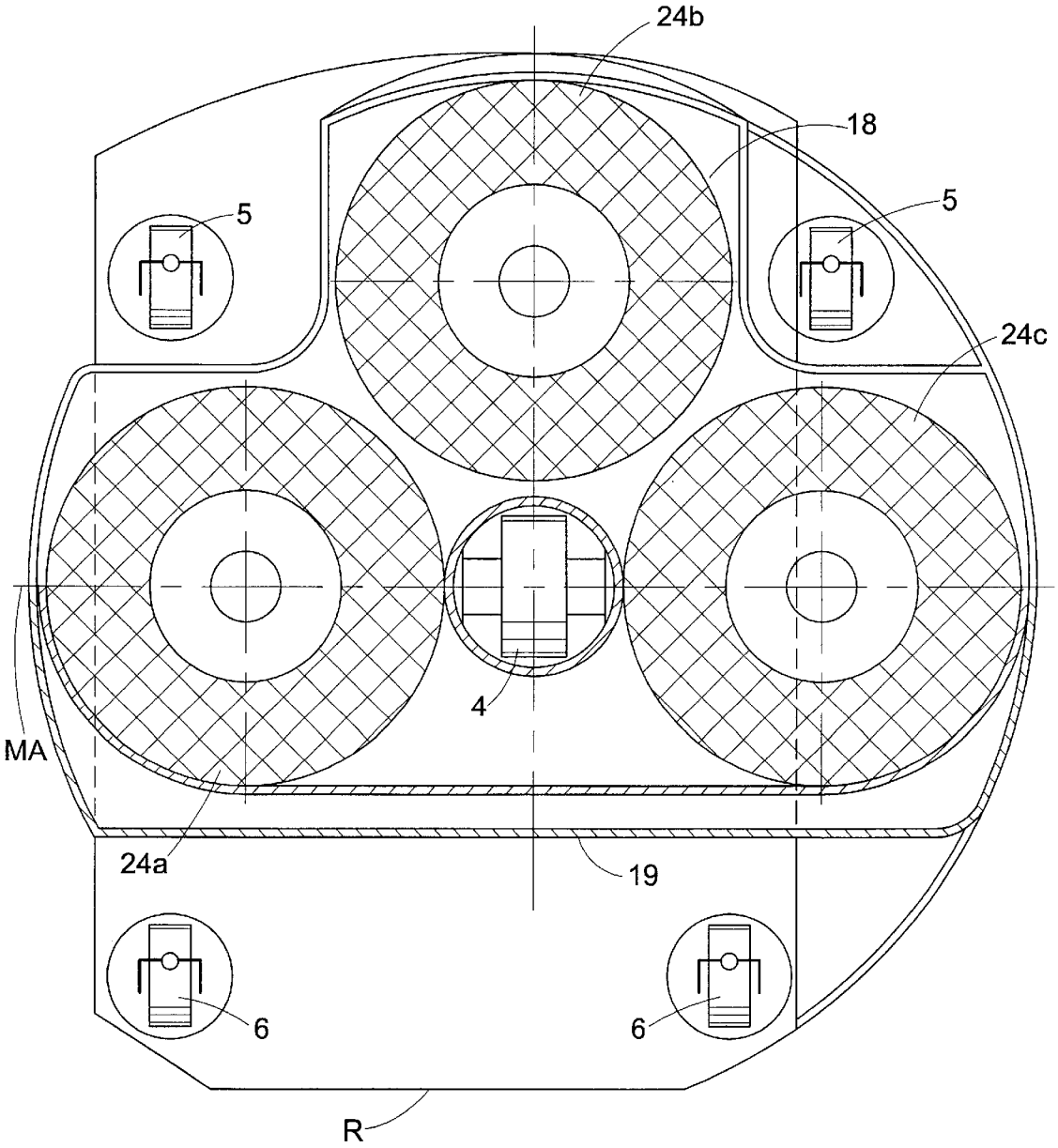
Figure 12A:
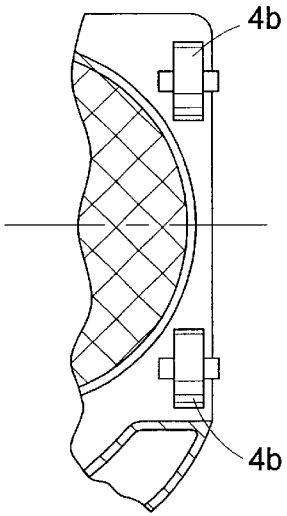
Figure 12:
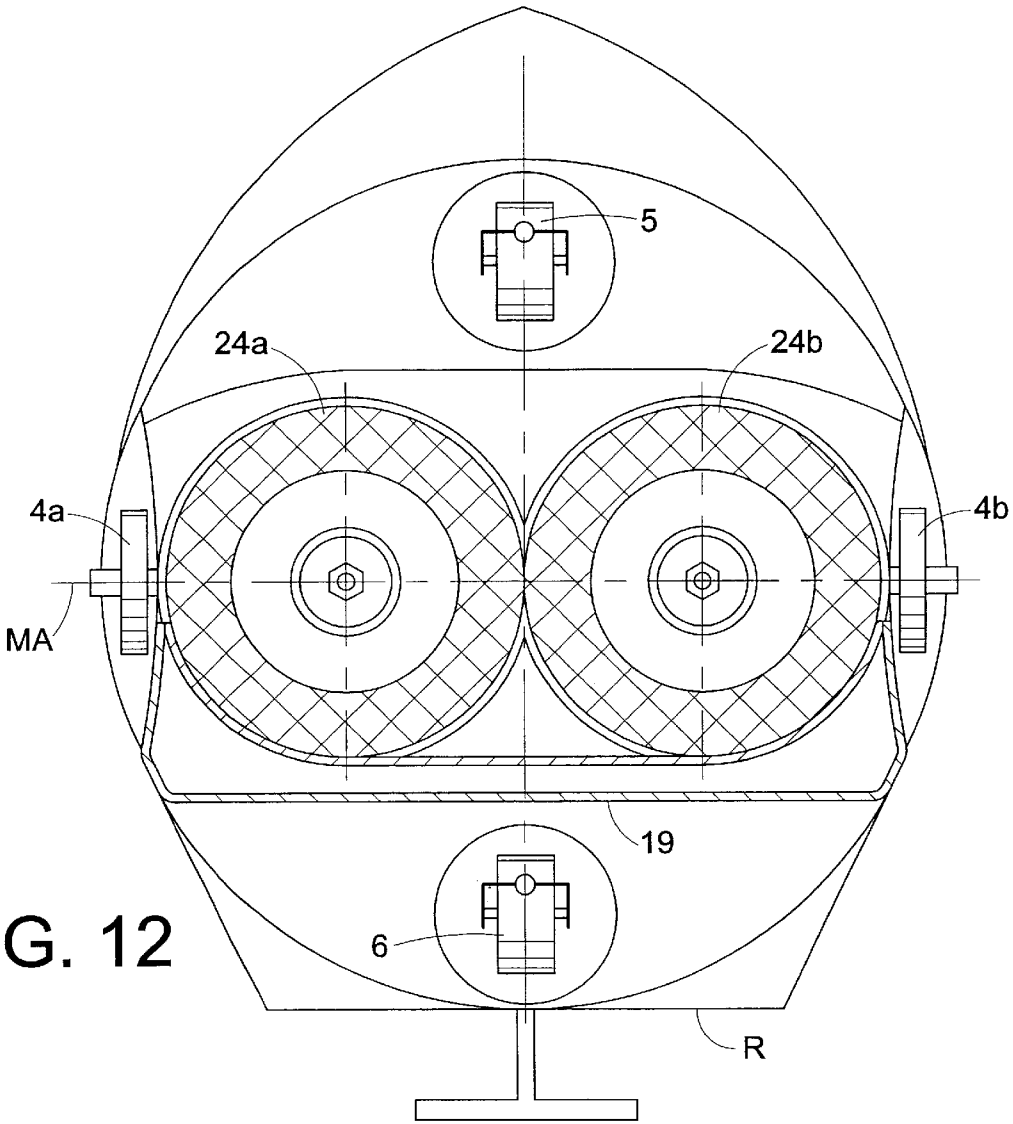

FIG. 9 shows a bottom view of a fifth floor cleaning apparatus;

FIG. 10 shows a bottom view of a sixth floor cleaning apparatus;

FIG. 11 shows a bottom view of a seventh floor cleaning apparatus;

FIG. 12 shows a bottom view of an eighth floor cleaning apparatus;

FIG. 12*a* shows a partial view of a variant according to FIG. 12, and

Figure 13:
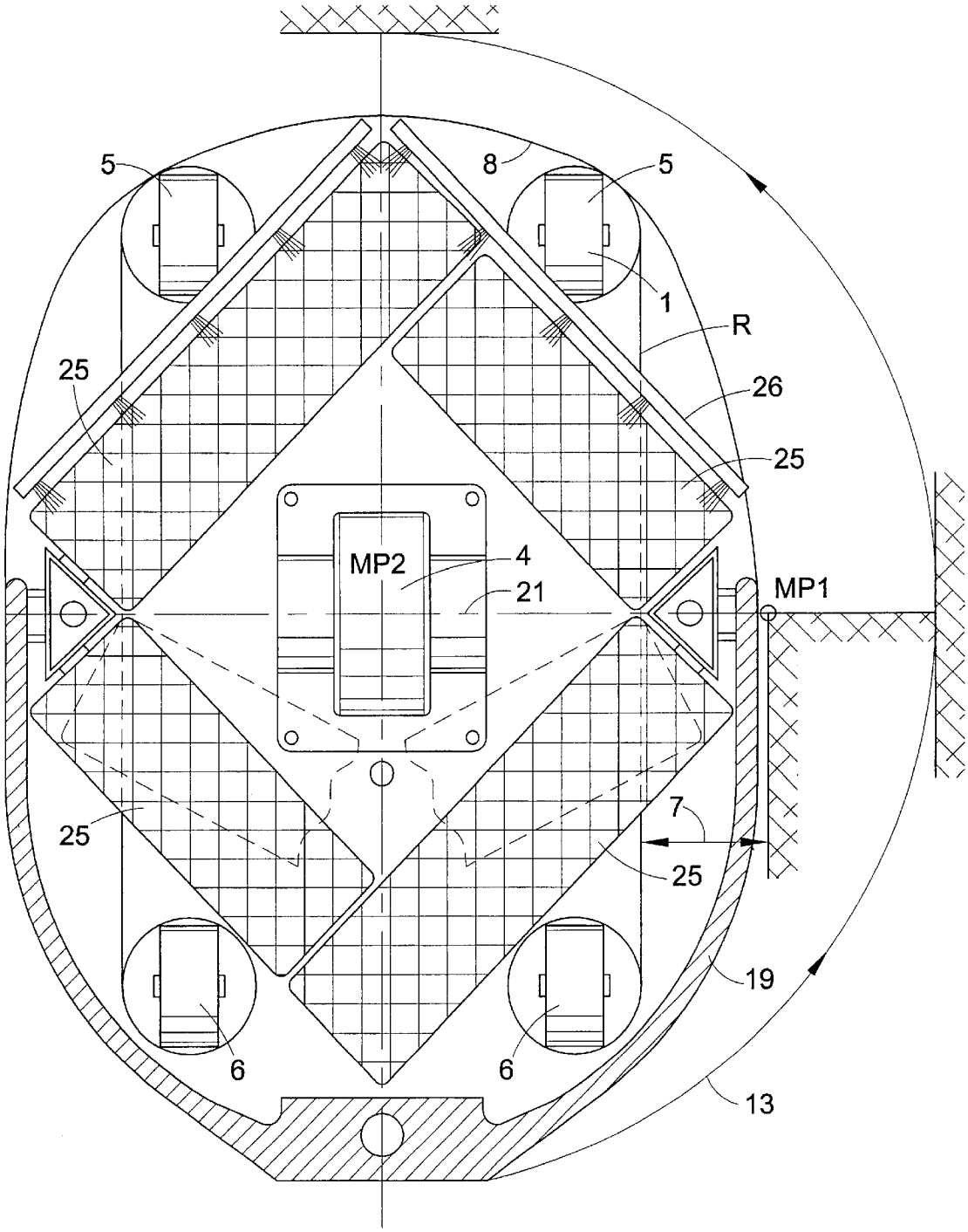

FIG. 13 shows a bottom view of a ninth floor cleaning apparatus.

Figure 1:
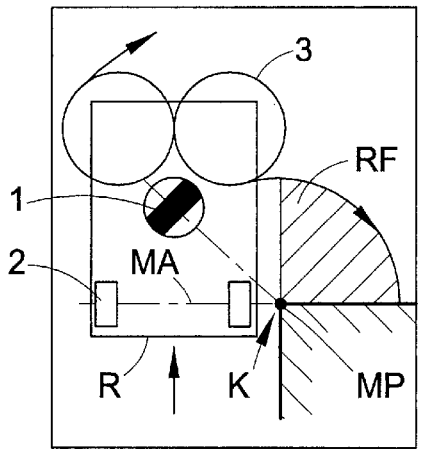
FIG. 1 (PRIOR ART)
FIG. 1 shows a schematic bottom view of a first apparatus according to the state of the art.
Figure 2:
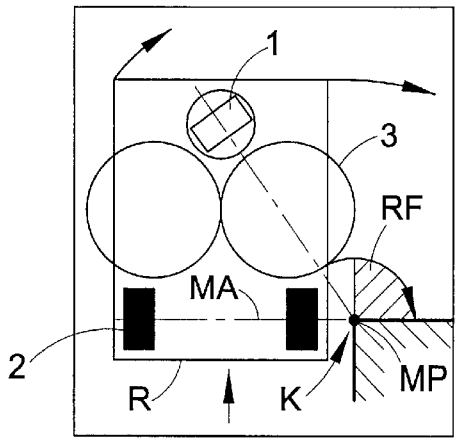
FIG. 2 (PRIOR ART)
FIG. 2 shows a schematic bottom view of a second apparatus according to the state of the art.
Figure 3:
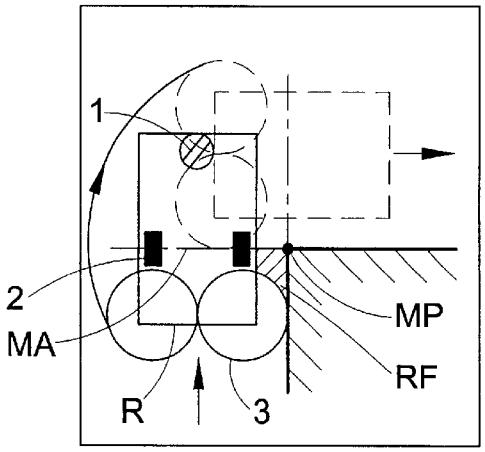
FIG. 3 (PRIOR ART)
FIG. 3 shows a schematic bottom view of a third apparatus according to the state of the art.

FIGS. 1 to 3 show schematic bottom views according to the state of the art of known arrangements of circular brushes and wheels in floor cleaning apparatuses.

In FIG. 1, a floor cleaning apparatus with a frame R is provided with a steered driven front wheel 1 and non-driven rigid rear wheels 2. A cleaning device formed of two circular brushes 3 is attached in front of the front wheel 1. In the floor cleaning apparatus as shown in FIG. 2 the front wheel 1 is not driven. The rear wheels 2 are driven. The circular brushes 3 are attached between the front wheels 1 and the rear wheels 2. FIG. 3 shows a cleaning device according to FIG. 2, with the circular brushes 3 being attached behind the rear wheels 2.

A momentary center designated with MP, or a momentary center of curve motion, is disposed on a momentary center axis MA which coincides in FIGS. 1 to 3 with the rear axle. The momentary center MP of the respective curve movement is given by the point of intersection of the axle of front wheel 1 with the momentary center axis MA. RF describes the remaining uncleaned residual surface after moving around a contour such as a rectangular projection K.

Figure 4:
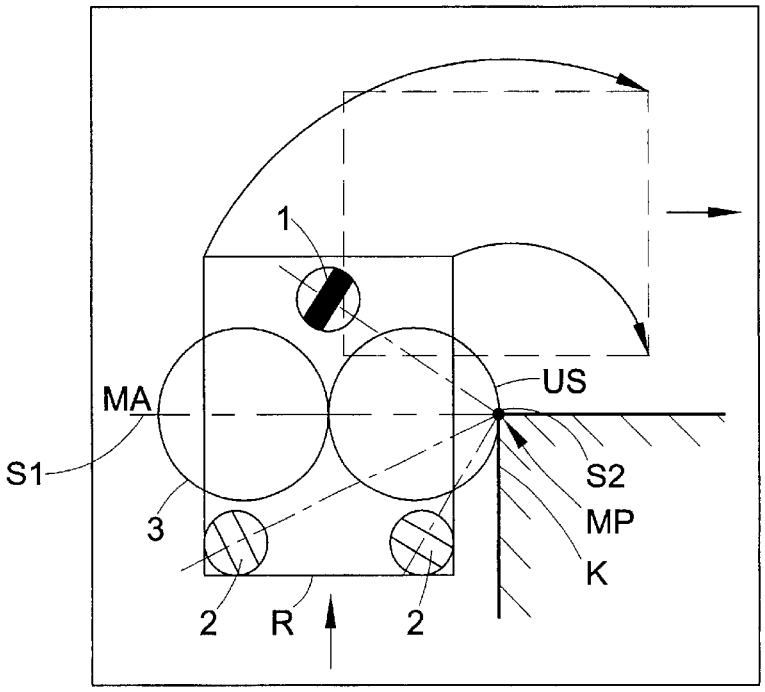
FIG. 4 shows a schematic bottom view of a first floor cleaning apparatus in accordance with the invention.

FIG. 4 shows a schematic bottom view of a first floor cleaning apparatus in accordance with the invention. The front wheel 1 is driven. The undriven rear wheels 2 are provided with a steerable arrangement in this case. The circular brushes 3 are arranged between the front wheel 1 and the rear wheels 2. The wheels 1, 2 are provided with forced steering in such a way that their axles always intersect with a momentary center MP disposed on a momentary center axis MA. The momentary center axis MA intersects the lateral circumferential edge US of a cleaning surface formed by the circular brushes 3 in the points of intersection S1, S2. The circumferential edge US projects in this case laterally beyond the frame R. The points of intersection S1 and S2 are disposed on the outermost lateral circumferential edge. The point of intersection S2 coincides here with the momentary center MP. The cleaning apparatus in accordance with the invention can be guided around the projection K without leaving any uncleaned residual surfaces behind.

Figure 5:
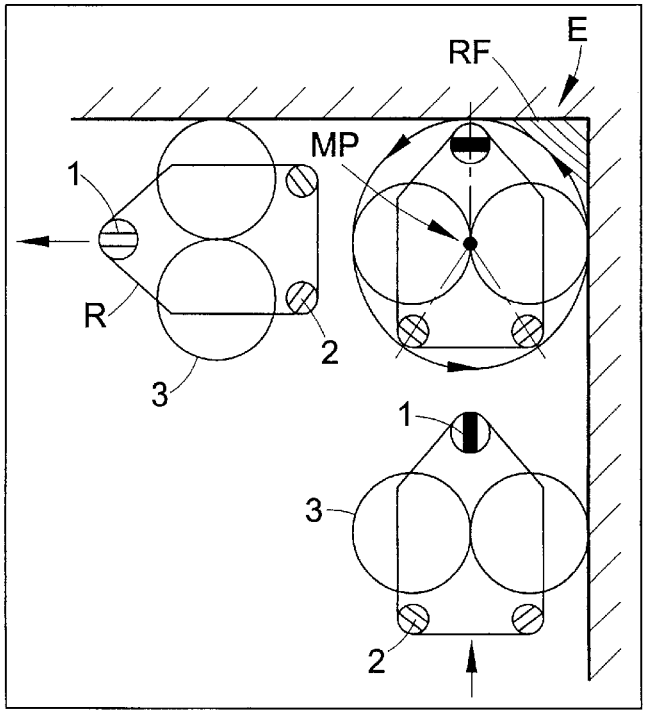
FIG. 5 shows a schematic bottom view of a second floor cleaning apparatus in accordance with the invention.

FIG. 5 shows a second floor cleaning apparatus in accordance with the invention which is similar to the one shown in FIG. 4. The frame R is provided with an arrangement which tapers in the forward direction. This helps to move past corner E in a particularly favorable manner. In this case too, the remaining uncleaned residual surface RF is particularly small in comparison with conventional cleaning apparatuses.

FIGS. 6*a* to *e* schematically show different possibilities for achieving a statically determined wheel load distribution. A non-steerable, preferably driven, wheel 4 is attached to frame R. The wheel 4 is held on the frame in a relatively vertically movable manner to the swivel wheels 5, 6. G designates the weight force of a supply unit (not shown) which is held on the frame R. The load removal of the supply device which occurs substantially by way of the central wheel 4 contributes substantially to the ease of handling capability offered by the floor cleaning apparatus.

Figure 6A:
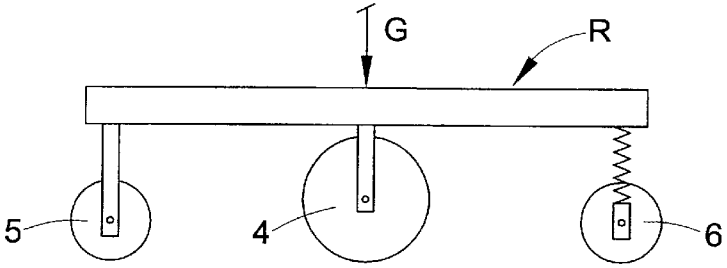
Figure 6B:
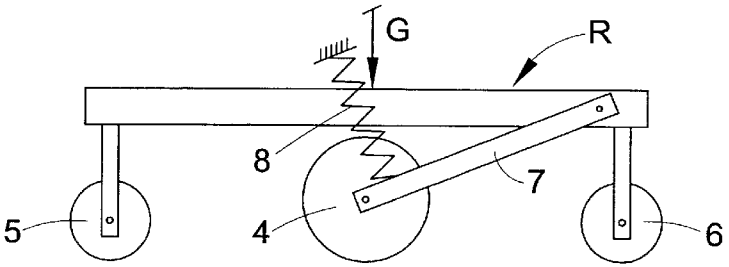
Figure 6C:
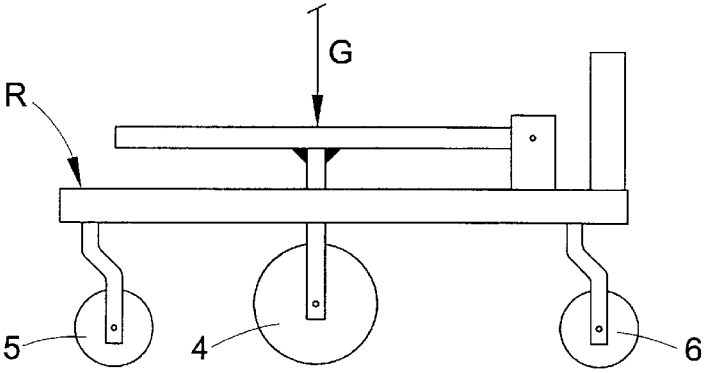
Figure 6E:
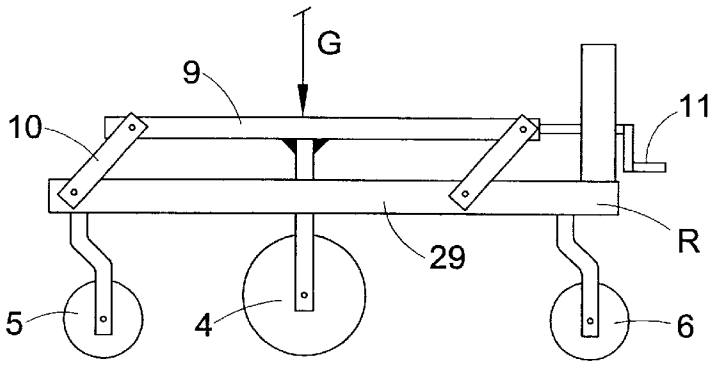
Figure 6D:
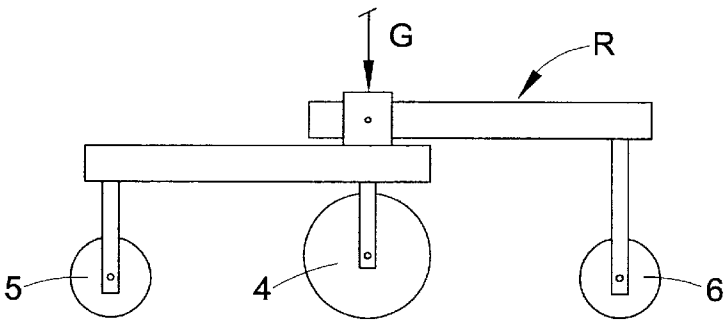

In the variant as shown in FIG. 6*a,* there are rear swivel wheels 6 which are received resiliently on frame R. In FIG. 6*b* the central wheel 4 is fastened to a rocker 7. The weight force G acts in this case via a spring 8 on the central wheel 4. In the variants as shown in FIGS. 6*c* and *d,* the weight force G acts directly on the central wheel 4; only the weight of frame R acts on the swivel wheels 5, 6. The variant as shown in FIG. 6*e* is regarded as being particularly advantageous. In this case the weight force G acts via a table 9 on the central wheel 4. Table 9 is held vertically movable on frame R by means of parallel rockers 10. A lifting device 11 is used to set the load distribution on the swivel wheels 5, 6 and the central wheel 4. The lifting device 11 also allows lifting the supply unit and then moving the entire floor cleaning apparatus into a suitable receiving frame (not shown) in which the supply device comes to lie on the receiving frame by subsequent lowering of the table 9. After the severing of supply lines the frame R can be pulled out from under the supply device and be used for receiving a further prepared supply device.

FIGS. 7*a* and *b* show a third floor cleaning apparatus in a side and rear view which makes use of the principle as shown in FIG. 6*e.* The central driven wheel 4 is attached rigidly to table 9. The table 9 is connected with frame R by means of parallel rockers 10. An electromotor 12 is attached in the vicinity of driven wheel 4 on its fixing device. The electromotor 12 can also be designed as a motor in the wheel hub and can be flange-mounted directly on the driven wheel 4. the table 9 can be moved vertically with respect to frame R by means of a lifting device 11 arranged as a crank. Table 9 removably receives a supply unit V which consists in particular of a tank 15, a battery unit 16 and a device (not shown here) for receiving the dirty water. A spring device 13 can be used to set a predetermined load distribution on the central wheel 4 and the swivel wheels 5, 6. It has proven to be favorable to remove 75% of the load of the supply unit V for example on the central wheel 4. A circular brush 3 and a suction apparatus 14, which are shown in this case on a reduced scale for reasons of clarity of the illustration, are attached on frame R.

A center of gravity of the apparatus is designated with SP. An axle A of the driven wheel 4 is disposed in the vertical projection of the center of gravity SP which is indicated with the arrow P. It is also possible that the axle A is attached close to the vertical projection of the center of gravity SP, i.e. some centimeters before or behind the vertical projection of the center of gravity S.

FIGS. 8*a* to *c* show a fourth floor cleaning apparatus. Two elliptical brushes 17*a,* 17*b* are enclosed in the edge by a brush apron 18 and a suction lip 19 adjacent thereto. The suction lip 19 can preferably be arranged in a vertically movable manner. The surface area enclosed by the brush apron 18 and the suction lip 19 corresponds substantially to the cleaning surface of the apparatus. The cleaning surface projects laterally beyond the frame R. This allows a cleaning of floor areas covered by furniture such as shelves for example and improved driving into and turning in corners. It is particularly advantageous if a housing contour is disposed in the zone of the cleaning device at least in sections on the circumference of a circle imagined about a central momentary center MP2. T he momentary center axis MA intersects the circumferential edge in an outermost lateral section in the vicinity of point MP1.

Two driven wheels 4*a,* 4*b* are arranged on the momentary center axis MA. Each of the driven wheels 4*a,* 4*b* is drivably connected by way of a first V-belt 20*a,* 20*b* with a separately controllable electromotor 21*a,* 21*b.* The steering of the apparatus is performed by different rotational speeds or a different direction of rotation of the first electromotors 21*a,* 21*b.* The drive of the wheels 4*a,* 4*b* can also occur by way of a differential gear. Two rear swivel wheels 6 and a front swivel wheel 5 are provided. The elliptical brushes 17*a,* 17*b* are driven by means of a second electromotor 22 by way of a second V-belt 23. The one elliptical brush 17*a* can be connected by way of a further second V-belt (not shown here) with the other elliptical brush 17*b.* It is also possible to use toothed belts or toothed gearings instead of the V-belt 20, 23.

The fourth floor cleaning apparatus can be rotated on the location by a reverse rotational motion of the first electromotors 21*a* and 21*b* about a second momentary center MP2 which is disposed between the driven wheels 4*a* and 4*b.* In the case of a rotational movement in the same direction of the first electromotors 21*a,* 21*b* with a different speed, the rotational movement can occur about a first momentary pole MP1.

FIG. 9 shows a bottom view of a fifth floor cleaning apparatus. A ring brush 24 is provided. In a central recess of the ring brush 24, there is attached a single central non-steerable wheel 4 whose axis is intersected by the vertical projection (not shown here) of the center of gravity of the apparatus. Rear swivel wheels 6 as well as front swivel wheels 5 are attached in the corners of the frame R which is arranged rectangularly in this case. The ring brush 24 is enclosed over a circumferential range of 180 degrees by a suction lip 19. The momentary center axis MA intersects the circumferential edge formed by the ring brush 24 laterally in an outermost point.

FIG. 10 shows a bottom view of a sixth cleaning apparatus. The frame is provided in the rear zone with a rectangular arrangement and in the front zone with a tapering arrangement.

Two rear swivel wheels 6 are arranged in the rear zone and a front swivel wheel 5 at the tapering front end of frame R. It is also possible to provide swivel wheels 5 on the left and right at the front of frame R. The axle of a central nonsteerable wheel 4 forms the momentary center axis MA. The wheel 4 is drivably connected by means of the first electromotor 21. Two ring brushes 24*a,* 24*b* which are arranged asymmetrically concerning the frame R are enclosed on the edge over sections by a brush apron 18. Adjacent thereto is a suction lip 19. The brush apron 18 and the suction lip 19 enclose in the form of an ellipse a cleaning area formed by the ring brushes 24*a,* 24*b*. The cleaning area projects in this embodiment on the one side of frame R. The momentary center axis MA intersects the circumferential edge in an outer lateral section close to point MP1. The contour of a housing enclosing the cleaning device is partly disposed here on the circumference of a circle imagined about the central momentary center MP2.

FIG. 11 shows a bottom view of a seventh cleaning apparatus with four swivel wheel 5, 6 for large cleaning areas. A central driven wheel 4 which is arranged in the vertical projection of the center of gravity (not shown) is provided with a non-steerable arrangement. It is enclosed by three ring brushes 24*a,* 24*b* and 24*c*. Frame R is provided with a substantially rectangular arrangement. The cleaning surface defined by the ring brushes 24*a,* 24*b* and 24*c* projects laterally beyond the frame R. The momentary axis MA intersects the circumferential edge laterally in the outermost point.

FIG. 12 shows a bottom view of an eighth cleaning apparatus. The axes of rotation of two adjacently disposed ring brushes 24*a,* 24*b* intersect the momentary center axis MA. The ring brushes 24*a,* 24*b* are attached between two rigid driven wheels 4. Furthermore, a rear swivel wheel 6 as well as a front swivel wheel 5 are attached on the frame R which tapers towards the front. The steering of the apparatus is performed by a separate drive of the two driven wheels 4*a* and 4*b*. Instead of the one driven wheel 4*a,* 4*b* which is provided at each side it is also possible to provide two driven wheels 4*a* and 4*b* on each side. Such an embodiment is shown in FIG. 12*a*. In this embodiment the momentary center axis MA also intersects the circumferential edge laterally in the outermost point. The circumferential edge does not project laterally beyond the frame R in this case, however.

FIG. 13 shows a bottom view of a ninth cleaning apparatus. A central driven wheel 4 is drivably connected with a first electromotor 21 which is arranged as a motor in the wheelhub. Front swivel wheels 5 and rear swivel wheels 6 are provided close to the corners of frame R. Cleaning rollers 25 which are rotatable rhombically about horizontal axes are attached between the swivel wheels 5, 6 and the central driven wheel 4. The cleaning rollers 25 which are attached close to the front wheels 5 are associated with nozzle lips 26 by means of which detergent can be sprayed onto the front cleaning rollers. The cleaning rollers which are attached close to the rear wheels 6 are enclosed by a suction lip 19. The momentary center axis MA forms points of intersection S1, S2 with the circumferential edge in the zone of the longitudinal side of the frame. Instead of the illustrated roller arrangement, it is also possible to provide a single cleaning roller which is arranged inclined to the momentary center axis MA.

LIST OF REFERENCE NUMERALS

1 Front wheel
2 Rear wheel
3 Circular brush
4 4*a, b* Driven wheel
5 Front swivel wheel
6 Rear swivel wheel
7 Rocker
8 Spring
9 Table
10 Parallel rocker
11 Crank
12 Electromotor
13 Spring device
14 Suction apparatus
15 Tank
16 Battery device
17 17*a, b* Elliptical brushes
18 Brush apron
19 Suction lip
20 20*a,b* First V-belt
21*a,b* First electromotors
22 Second electromotor
23 Second V-belt
24 24*a, b, c* Ring brush
25 Cleaning roller
26 Nozzle lip
K Projection
E Corner
R Frame
S1, S2 Points of intersection
MP1 Momentary center
MP2 Central momentary center
MA Momentary center axis
RF Uncleaned residual surface area
SP Center of gravity
A Axis
V Supply unit

What is claimed is:

1. An apparatus for floor cleaning, said apparatus having a plurality of wheels (4, 5, 6) attached to a frame (R) such that a curve movement can be selectively performed about any one of a plurality of momentary centers (MP, MP1, MP2), wherein each of the wheels has an axis of rotation and each of the plurality of momentary centers (MP, MP1, MP2) is located at an intersection of a momentary center axis (MA), which extends substantially transverse to the frame (R), and the axes of rotation of the plurality of wheels, said apparatus also having a cleaning device (3, 17*a,* 17*b,* 24, 25) that is received in the frame (R), said cleaning device forming a cleaning area that is delimited by a circumferential edge, wherein the momentary center axis (MA) forms at least one point of intersection (S1, S2) with a section of the circumferential edge that is disposed along a longitudinal side of the frame (R).

2. The apparatus as claimed in claim 1, wherein the apparatus has a center of gravity (SP) and the momentary center axis (MA) extends in the vicinity of a vertical projection of the center of gravity (SP).

3. The apparatus as claimed in claim 2, wherein at least one non-steerable wheel (4) is attached to the frame along the momentary center axis (MA) in the vicinity of the vertical projection of the center of gravity (SP).

4. The apparatus as claimed in claim 1, wherein the plurality of wheels (4, 5, 6) include at least two wheels (5, 6) that are attached to the frame (R), and wherein said at least two wheels (5, 6) are selected from the group consisting of swivelable and steerable wheels.

5. The apparatus as claimed in claim 1, wherein two wheels (4*a,* 4*b* ) are arranged on the momentary center axis (MA), and wherein the two wheels are driven wheels.

6. The apparatus as claimed in claim 5, wherein the driven wheels (4*a,* 4*b* ) are adapted to be driven at different speeds and/or in different directions of rotation.

7. The apparatus as claimed in claim 1, wherein the cleaning device comprises at least one circular brush (3, 24, 24*a,* 24*b* ).

8. The apparatus as claimed in claim 1, wherein the cleaning device comprises at least one cleaning roller (25).

9. The apparatus as claimed in claim 1, further comprising a supply unit (V), said supply unit being an exchangeable module and comprising a tank (15), a device for receiving dirty water, and a power supply unit (16).

10. The apparatus as claimed in claim 1, wherein the several wheels include at least one non-steerable wheel (4) and swivel wheels (5,6), said at least one non-steerable wheel being attached to the frame in a vertically movable fashion relative to the swivel wheels (5, 6).

11. The apparatus as claimed in claim 10, wherein the at least one non-steerable wheel (4) is received in a lifting apparatus (11) or a resiliently held rocker (7).

12. The apparatus as claimed in claim 10, wherein the apparatus has a weight, and wherein the apparatus further comprises a device (9, 10, 11) for adjusting distribution of the weight between the at least one non-steerable wheel (4) and the swivel wheels (5, 6).

13. The apparatus as claimed in claim 10, wherein a motor (21, 21*a,* 21*b*) is provided for driving the at least one non-steerable wheel (4).

14. The apparatus as claimed in claim 1, wherein stop wheels are provided on a brush cover (18).

15. The apparatus as claimed in claim 14, wherein the stop wheels are arranged with an axial offset Δy in front of the momentary center axis, with the following applying:

$$\Delta y = aD_{brush\ diameter}$$

with a being between about 0.15 to 0.35 and $D_{brush\ diameter}$ being a diameter of the brush (3, 17*a,* 17*b,* 24).

16. The apparatus as claimed in claim 1, further comprising a housing having a peripheral contour, wherein at least portions of the peripheral contour falls upon a circle centered on a central momentary center (MP2).

17. The apparatus as claimed in claim 1, wherein the at least one point of intersection (S1, S2) is disposed on an outermost lateral section of the circumferential edge that projects beyond the longitudinal side of the frame.

* * * * *

UNITED STATES PATENT AND TRADEMARK OFFICE
Certificate

Patent No. 6,553,609 B2 Patented: April 29, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dieter Tremmel, Nurnberg (DE); Peter Belkhofer, Forchheim (DE); Andreas Kistner, Merkendorf (DE); Michael Kotz, Forchheim, (DE); Christian Neumann, Hagenau (DE); Markus Merkl, Pressath (DE); Holger Sandner, Bubenreuth (DE); Barbara Kissich, Spardoff (DE); Udo Utz, Ditzingen (DE); and Stanislav Massini, Langenzenn (DE).

Signed and Sealed this Second Day of June 2009.

JOSEPH J. HAIL, III
*Supervisory Patent Examiner*
Art Unit 3723